United States Patent [19]

Dewhirst

[11] 3,963,057

[45] June 15, 1976

[54] METHOD OF MAKING PILE FABRICS AND THE PILE FABRIC MADE THEREBY

[75] Inventor: Geoffrey Wilson Dewhirst, Broughty Ferry, Scotland

[73] Assignee: Thomson Shepherd and Company Limited, Dundee, Scotland

[22] Filed: Nov. 29, 1974

[21] Appl. No.: 528,127

[30] Foreign Application Priority Data

Dec. 4, 1973 United Kingdom ..... 56119/73

[52] U.S. Cl. ..... 139/2; 139/7 D; 139/7 F

[51] Int. Cl.[2] ..... D03D 39/08

[58] Field of Search ..... 139/7 R, 7 A–7 G, 139/2, 3, 4, 5, 6, 399, 400; 112/79 R, 79 A; 156/72

[56] References Cited

UNITED STATES PATENTS

| | | | |
|---|---|---|---|
| 2,918,944 | 12/1959 | Park et al. | 139/7 R |
| 3,187,779 | 6/1965 | Smiley et al. | 139/7 F |
| 3,354,914 | 11/1967 | Carrigan et al. | 139/399 |
| 3,400,738 | 9/1968 | Fleischer et al. | 139/2 |

FOREIGN PATENTS OR APPLICATIONS

| | | | |
|---|---|---|---|
| 416,674 | 9/1934 | United Kingdom | 139/7 D |
| 860,207 | 2/1961 | United Kingdom | 139/7 D |
| 1,286,138 | 8/1972 | United Kingdom | 139/7 R |
| 5,776 | 1897 | United Kingdom | 139/2 |
| 525,435 | 8/1940 | United Kingdom | 139/2 |

*Primary Examiner*—James Kee Chi
*Attorney, Agent, or Firm*—Alan H. Levine

[57] ABSTRACT

A method of making an Axminster carpet having different heights of pile in the same pile forming pick in which yarn carriers selected to supply high pile are given an additional lift to position the yarns drawn therefrom out of the general plane of yarns drawn-off nonselected carriers. Thereafter means, such as a finger mounted on the knife box, is traversed across the loom ahead of the knife to engage the selected yarns and lengthen them.

8 Claims, 5 Drawing Figures

Figure 1:
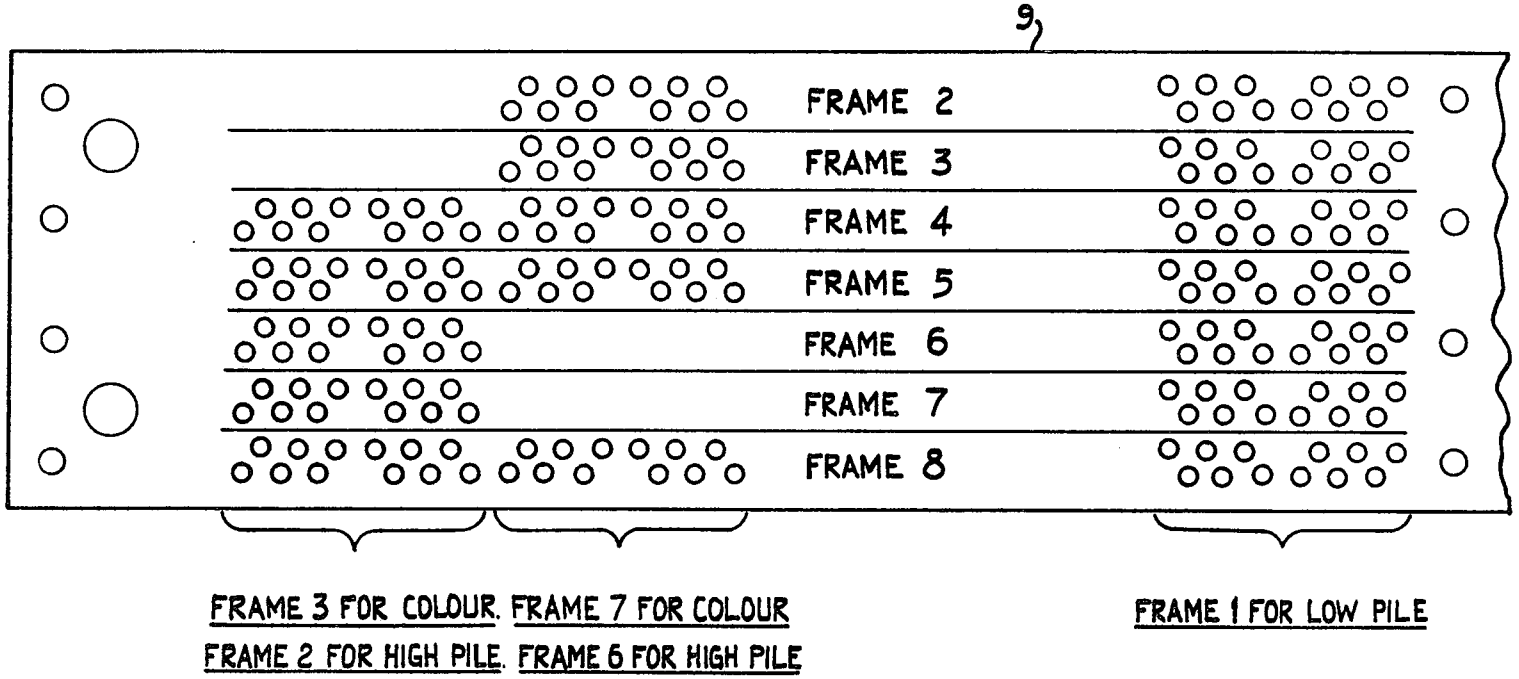

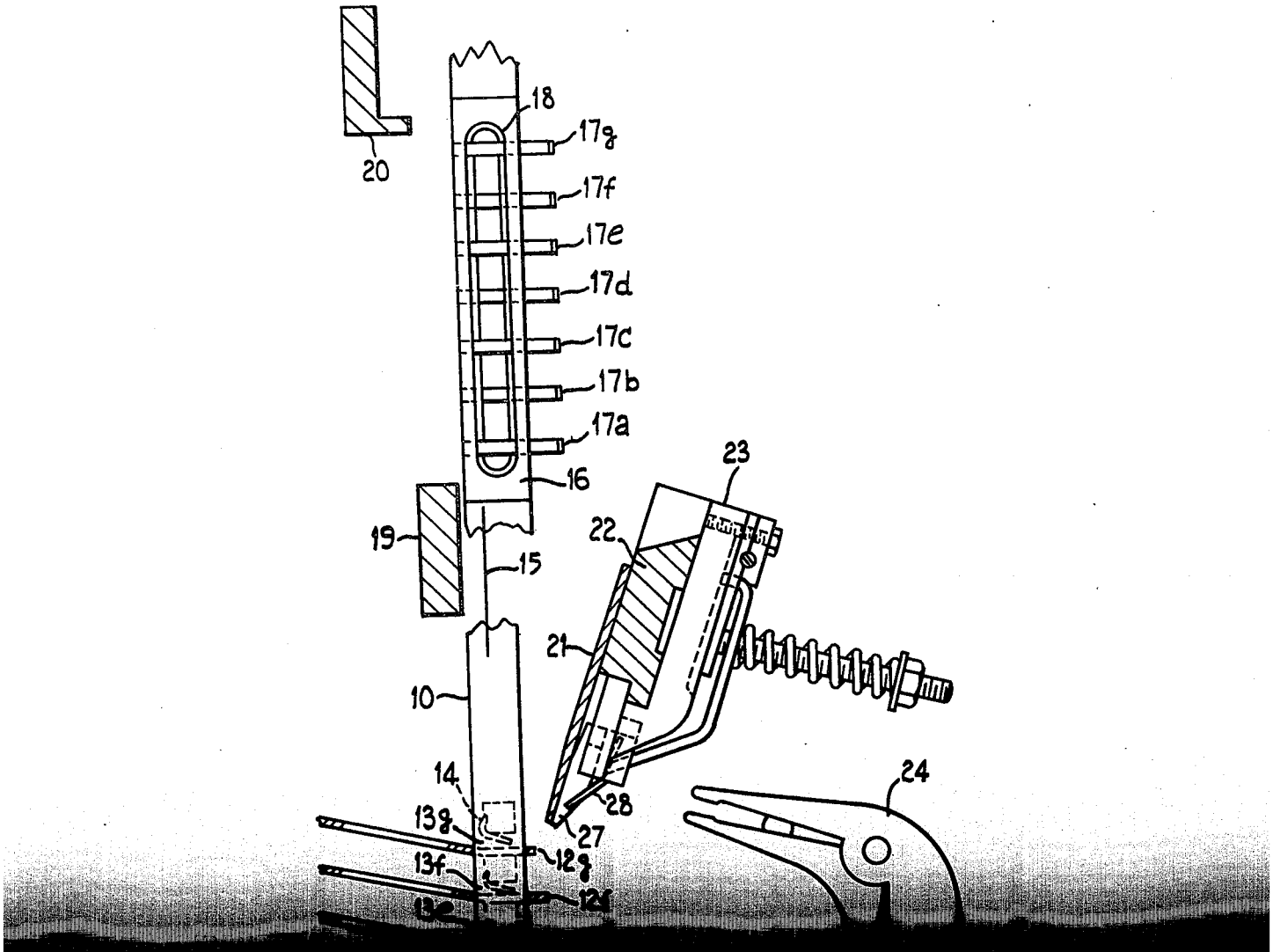
18
17g
17f
17e
17d
17c
17b
17a
20
16
19
15
23
22
21
10
14
13g
13f
13e
12g
12f
28
27
24

METHOD OF MAKING PILE FABRICS AND THE PILE FABRIC MADE THEREBY

This invention relates to a method of manufacturing pile carpets, wall carpets, floor rugs and mats, and the pile carpets, wall carpets, floor rugs and mats made thereby, and has for its object to produce in machine made carpets and the like, different heights of pile in plain or patterned Axminster-type carpets.

It has previously been proposed in Axminster-type carpets to produce two or more heights of pile by the use of special type yarns with built-in characteristics that change the appearance of the carpet in processes carried out subsequent to weaving.

Recently we have proposed a method in which two or more heights of pile are produced in a carpet during weaving (British Patent No. 1286138). In accordance with the method disclosed in the aforementioned patent, high and low pile is produced on alternate pile forming picks. The present invention is designed to enable different heights of pile to be produced during weaving in the same pile forming pick with the use of any type of pile yarn capable of being used as pile in carpet produced by the gripper Axminster process.

This invention is based on the gripper method of inserting tufts into a foundation structure woven concurrently with the tuft insertion and provides a method of weaving Axminster pile carpet on a gripper loom having yarn carriers and a gripper associated with each yarn carrier comprising for each pile forming pick, selecting yarn carriers which are to supply high pile yarn, selecting yarn carriers which are to supply low pile yarn, gripping yarn on said selected carriers, moving said grippers and yarn carriers relative to each other to draw yarn off said carriers, causing yarn carriers which are to supply high pile yarn to perform an additional movement whereby at least a part of the yarn drawn thereoff is lifted out of the plane generally defined by yarns drawn off yarn carriers supplying low pile yarn, increasing the length of yarn drawn off carriers supplying high pile yarn and subsequently cutting the yarns drawn off all selected yarn carriers. The number of different pile heights of pile may be selected as desired within the limitation of the loom, but preferably the method is used to produce carpets having two different pile heights.

A jacquard punched card has been used to control colour selection in the past and this may be used to control which threads are to be of high or low pile.

Any yarn can be used in the method according to the invention, but it is preferred to use yarn of the type employed in conventional weaving by the gripper method.

U-shaped tufts are preferably used to produce a smooth, level pile appearance and Rya or J-shaped tufts are used to produce a textured pile appearance. If desired, a combination of U-shaped and Rya or J-shaped tufts can be used.

The carpet produced by the method according to the invention may be a carved Axminster carpet in which case the carved areas preferably have a low pile.

The method according to the invention can be applied to conventional looms without affecting the loom speed or the mechanical efficiency thereof. When a loom has been adapted to carry out the present invention it can still produce conventional Axminster carpets having a constant pile height.

Figure 2B:
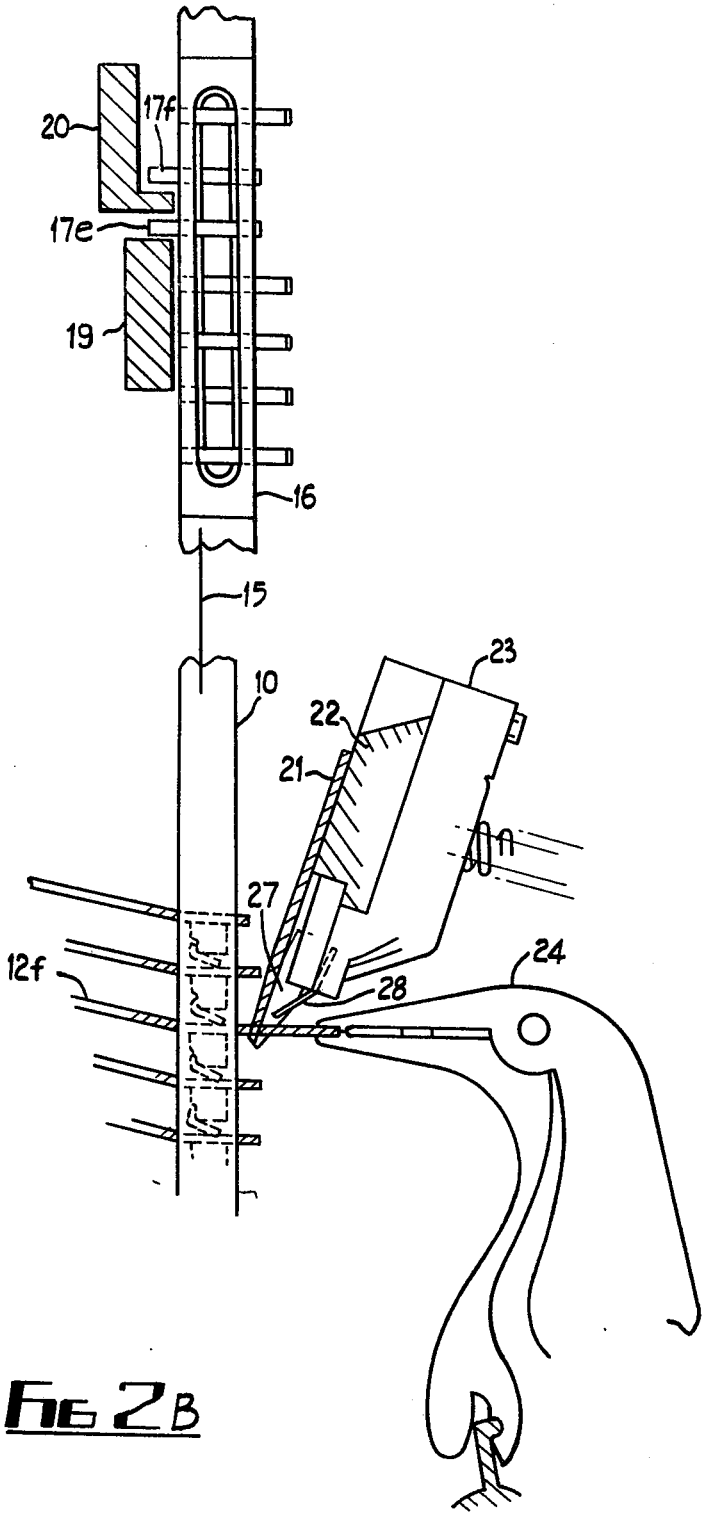
Figure 2C:
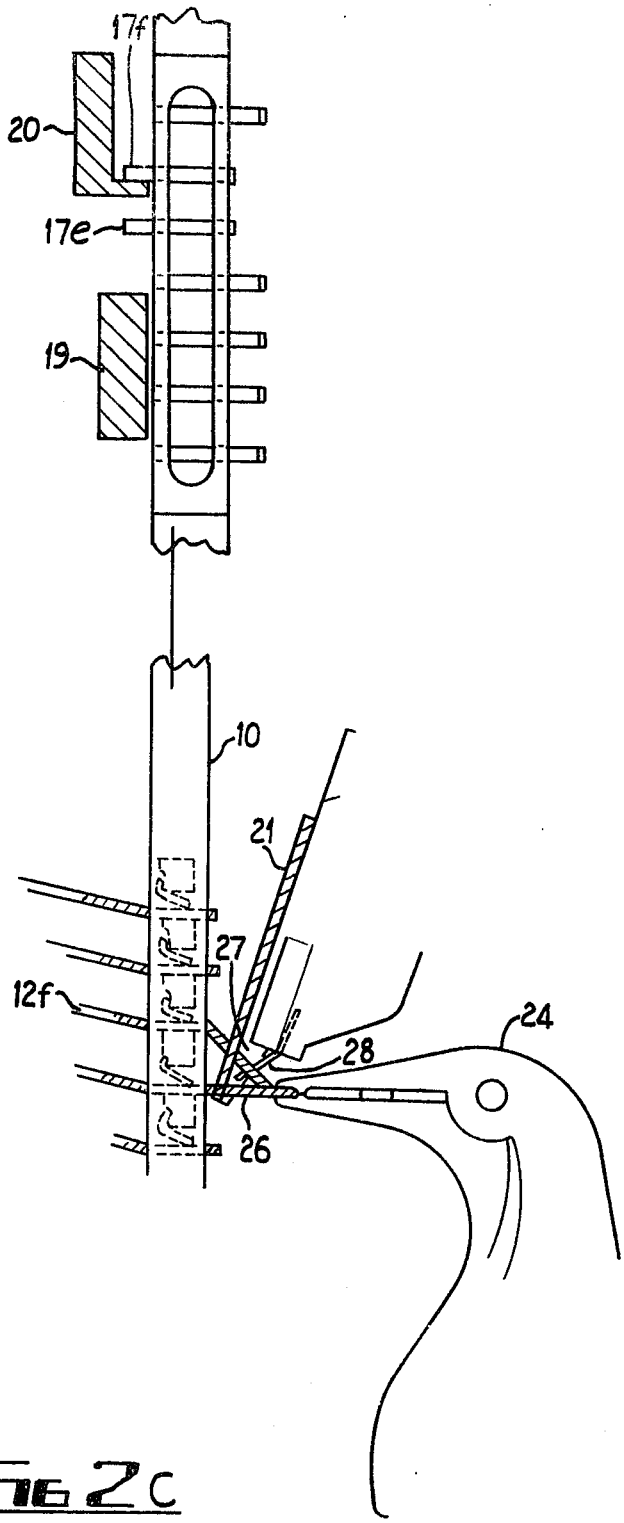
Figure 7:
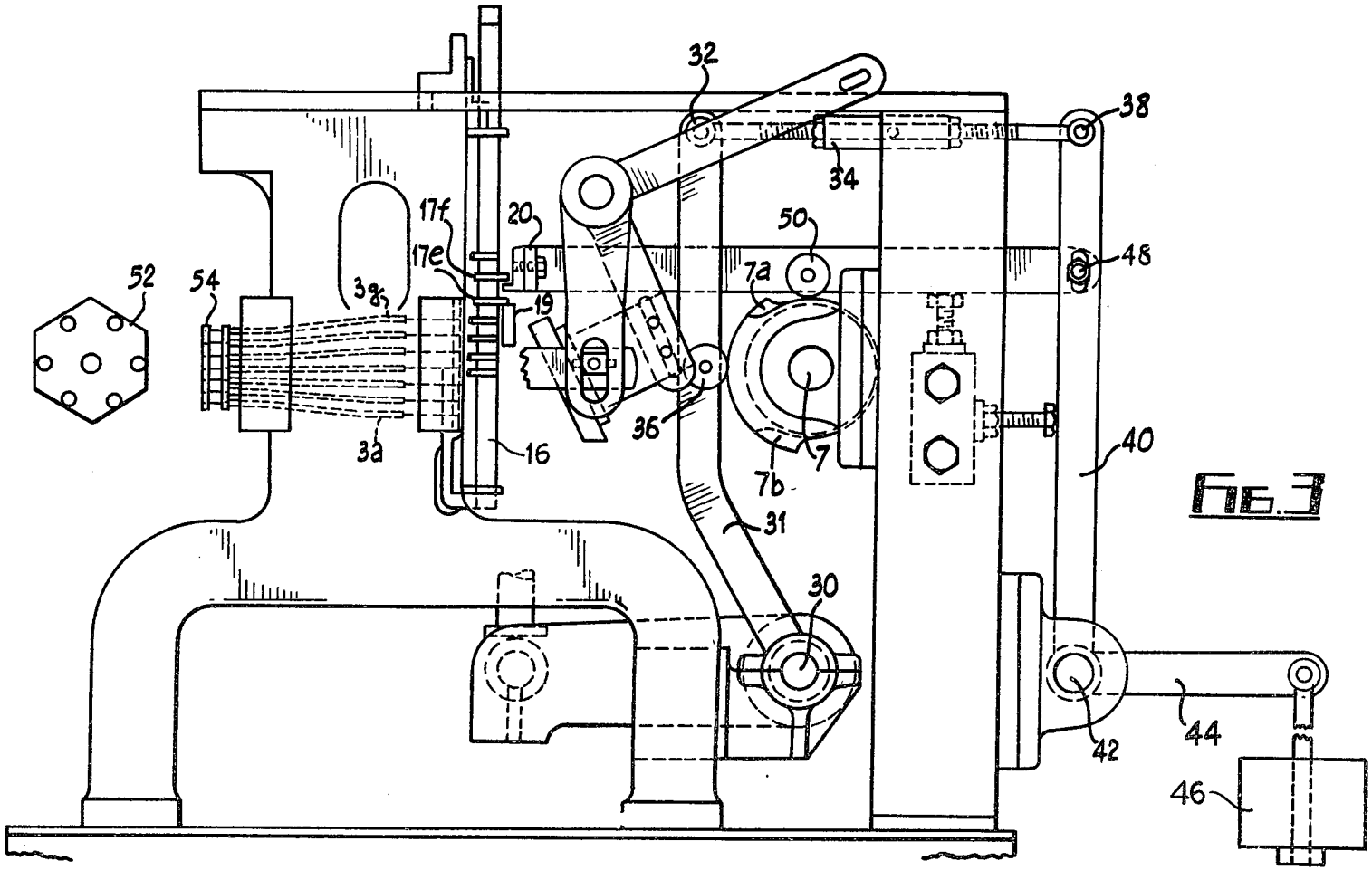

A specific embodiment of the invention will now be described by way of example with reference to the accompanying drawings, in which:

FIG. 1 shows a diagram of part of a punched card for high and low pile,

FIGS. 2*a*–2*c* are diagrammatic representations of the parts involved in producing high and low pile and FIG. 3 is an end elevation of the jacquard lifting system.

In designing a carpet it is usual to start by making a plan of the pattern on squared paper, with each square representing a tuft of pile yarn. One row of tufts shown on the design paper by one row of coloured squares are, by normal practice, inserted into the backing structure simultaneously, and this is carried out every third pick of weft for what is known as three-shot construction, and every second pick of weft for what is known as two-shot construction.

In the present invention the high and low pile is inserted on the same pile forming pick. In the gripper Axminster method of producing carpet, yarn is available for use and is supported in what are called yarn carriers. Each yarn carrier having space for a fixed number of pile yarns, for example eight spaces in a yarn carrier for an eight-frame loom and 12 spaces in a yarn carrier for a 12-frame loom.

The jacquard mechanism which is the conventional method of controlling colour selection in gripper Axminster looms is also programmed to determine which of the tufts shall be in long pile and which of the tufts shall be in short pile.

To control the selection of high pile and low pile the design paper is prepared in the normal manner.

When jacquard cards are cut for a loom weaving high and low pile in the same pile forming pick, a blank in the jacquard card has to be left according to the normal practice for which colour is required in the design and a blank is also required in the frame above for all colours that are required to be produced in the carpet in high pile, as shown in FIG. 1, and is described as follows:

The card 9 is a jacquard punched card conventionally used for controlling colour selection and in this invention for also controlling which tufts shall be long pile.

The jacquard card 9 has space for fourteen rows of holes, two rows for each frame in the loom other than frame 1, which is the neutral position and therefore does not require to be programmed.

In programming a jacquard card, holes are punched for no movement and blanks are left when it is required to activate the jacquard machine.

FIG. 1 is an example of how a jacquard card is programmed to carry out the present invention. On jacquard card 9, vertical rows 1 to 12 inclusive have holes punched for no movement with respect to frames 4 to 8 inclusive. For frame 3 there are twelve blank spaces in rows 1 to 12 for selecting the colour carried in the frame 3 in the loom, and frame 2 also has blanks in rows 1 to 12 to indicate that the pile yarn threads from frame 3 shall be produced in high pile.

Similarly vertical rows of holes 12 to 24 inclusive on jacquard card 9 are programmed to select the colour carried in frame 7 in the loom and to indicate that the pile yarn threads contolled by vertical rows 12 to 24 inclusive shall be produced in high pile.

In the normal operation of a gripper Axminster loom, colour selection is controlled by a punched card which through a mechanical system lifts one of the coloured pile threads to a fixed position in line with the mouth of the gripper mechanism. The gripper mechanism closes on the plurality of selected pile threads across the width of the loom and either the yarn carriage or the gripper mechanism moves a fixed distance according to the length of tuft required.

The tufts are then cut to length and the gripper mechanism moves downwards towards the backing structure for the tuft to be woven into the carpet.

The invention differs from normal practice inasmuch as after movement of the yarn carriage has been made for the short pile tufts, the jacquard selectors lift a further distance by a mechanical engagement in the selector peg above the frame that is required for colouring purposes. This lifts the pile threads required for high pile into the specially prepared deep teeth in a Van Dyke comb, whose depth is increased to enable the threads to be lifted as aforesaid.

Having separated the tufts that are to produce high pile from those that are to produce low pile by lifting them higher, the normal cutting mechanism on the loom begins to operate, but operating in conjunction with but slightly ahead of the cutting knife, is a pile looper that increases the tuft length, that is to produce high pile, the required amount.

Referring now to FIG. 2*a*, a yarn carrier 10 supports pile yarns 12*a*, 12*b*, 12*c*, 12*d*, 12*e*, 12*f* and 12*g* in spaces 13*a*, 13*b*, 13*d*, 13*e*, 13*f* and 13*g* respectively. The pile yarns are held in place tensioned by springs 14.

The yarn carrier 10 is free to move in a near vertical direction to present the colour required to the mouth of a gripper mechanism 24.

The carrier 10 is raised and lowered through its connection 15 with a selector 16. Selector 16 contains selector pins 17*a*, 17*b*, 17*c*, 17*d*, 17*e*, 17*f* and 17*g*. The selector pins are tensioned by a flat spring 18 and are slidable relative to the selector substantially horizontally.

A lifting bar 19 and a supplementary lifting bar 20 are provided adjacent the selector. The lifting bar 19 is of the kind normally provided in Axminster looms and will therefore not be described in any further detail.

As shown in FIG. 3 a cam shaft 7, drivable in a 1/1 ratio off the main loom shaft (not shown) has cams 7*a* and 7*b* rotatable therewith. A lever 31, is pivotally mounted at one end 30 to a part of the loom, and is pivotally connected at its other end 32 to one end of a connecting rod 34. A cam follower 36 is provided on the lever 31 intermediate its ends. The other end 38 of the connecting rod is pivotally connected to one end of a lever 40 mounted, at its other end, for rotation about a shaft 42. The lever 40 is urged in the clockwise direction (as viewed in FIG. 3) by a lever 44 also mounted on the shaft 42 and having a weight 46 fixed thereto. The supplementary lifting bar 20 is pivotally mounted at 48 on the lever 40 and extends substantially horizontally therefrom so that its free end is adjacent the selector 16. The supplementary lifting bar is supported, intermediate its ends by a cam follower 50 which rides on the cam 7*b*.

As shown in FIG. 2*a* the loom also comprises a knife assembly traverse box comprising a knife comb 21, a knife slide 22 and a knife 27 of the kind normally provided in Axminster looms except that the depth of the comb teeth is greater. Further the knife traverse box has an arm 28 fixed thereto which we call a "pile lengthening finger". The pile lengthening finger is located in front of the knife so that it will engage a selected high pile yarn before that selected yarn is cut and, provided it fulfills that function may be of any desired configuration. Examples of pile lengthening fingers are described in our co-pending application Ser. No. 528,130, filed the same date as this application.

The apparatus just described operates as follows:

Jacquard cards (not shown) laced together in an endless chain are supported on card cylinder 52 (FIG. 3). The cards move into contact with a needle plate 54 so that needles 3*a–g* are moved towards the right (as viewed in FIG. 3 of the drawing) in accordance with the programme on the cards. The movement of a needle causes corresponding movement of a selector pin.

In accordance with this embodiment of the present invention the cards are programmed so that two adjacent selector pins are moved when high pile is required and, for the sake of example, the embodiment shown in the drawings, yarn 12*f* is required in high pile and therefore pins 17*e* and 17*f* are to be selected. Thus the card programme has two blanks opposite needles 3*e* and 3*f* and the movement of those needles causes pins 17*e* and 17*f* to move horizontally with respect to the selector into the position shown in FIG. 2*b*.

Knife comb 21, knife slide 22 and knife assembly traverse box 23 are in their raised position shown in FIG. 2*a* to allow movement of gripper 24 forward towards carrier 10 to receive the pile yarn presented to it.

The lifting bar 19 then moves upwardly and, on engaging pin 17*e* lifts the selector and the yarn carrier from the position shown in FIG. 2*a* into the position shown in FIG. 2*b*. The mouth of the gripper 24 then closes on the yarn 12*f*, the yarn carrier 10 having moved the required distance to present yarn to produce a low pile tuft and the knife traverse box is lowered so that pile yarn 12*f* is engaged in the teeth of the comb. On completion of that movement the high profile of cam 7*a* causes lever 31 to rotate anticlockwise which through connecting rod 34 causes a corresponding anti-clockwise rotation of lever 40. The free end of the supplementary lifting bar 20 is thus moved beneath pin 17*f*. Thereafter further rotation of cam shaft 7 causes the high profile of cam 7*b* to raise the supplementary lifting bar and lift the yarn carrier through a further vertical distance into the position shown in FIG. 2*c*. The high pile yarn 12*f* whose free end is held in the gripper is now inclined to the horizontal, this being permitted by virtue of the deeper teeth on the comb.

The knife traverse box then moves to sever the pile yarn drawn off the carrier. However, the pile lengthening finger 28, which is ahead of the knife, engages the inclined high pile yarn and increases the drawn off length thereof before the knife cuts it.

As can be seen in FIG. 2*c* the pile lengthening finger only engages the high pile yarns and does not engage any low pile yarns which remain horizontal, one of which is shown and referenced 26.

After cutting has taken place the parts return to their neutral position shown in FIG. 2*a* whereupon the card cylinder rotates to present the next jacquard card to the needles and the cycle is repeated.

In order that U-shaped high and low pile can be produced in the same pile forming pick, the distance that the high pile tufts are lifted into comb 21 and the angle of comb 21 to carrier 10 is adjustable, in order to regulate the amount of pile yarn protruding from carrier 10 when in its neutral position, prior to recommencement of the operating cycle.

The above description indicates how pile of different height can be formed on the same pick, that is to say the pile forming pick. In accordance with the present invention however it is possible to produce pile of different height on any of the picks in a group of pile forming picks, that is to say either of the two picks in a two shot construction or any of the three picks in a three shot construction. Thus for example in a three shot construction the pile of one height can be produced on one of the three picks in a group of pile forming picks and pile of a different height on another of the three picks in the same group of pile forming picks. In order to achieve this the gripper mechanism must operate at a faster speed, e.g. in the case of the above examples, for two picks out of every three picks instead of one pick out of every three picks as is conventional in three shot construction.

What is claimed is:

1. A method of increasing the length of selected tufts in each row of tufts produced by an Axminster gripper loom having yarn carriers and a gripper associated with each carrier, comprising the steps of:

a. gripping a plurality of yarns in the grippers, b. drawing yarn off the yarn carriers by relative movement between the carriers and grippers, all the drawn yarns being in substantially a single plane in the region between the yarn carriers and the grippers, c. moving at least one selected yarn carrier so as to move its respective yarn out of the plane occupied by the unselected yarns in the region between the yarn carriers and the grippers, d. moving an element crosswise of the yarns along a path such that the element engages only the selected yarn which has been moved out of the plane occupied by the unselected yarns so as to lengthen that yarn by drawing additional yarn off only the selected yarn carrier, and e. cutting all the yarns.

2. A method as defined in claim 1 wherein said element and a cutting knife are moved simultaneously in the same direction, said element moving ahead of said knife so that it engages the selected yarn prior to cutting of the selected yarn by the knife.

3. A method as defined in claim 1 wherein the selected yarn carrier is moved transverse to the direction of said relative movement between the yarn carriers and grippers in order move its respective yarn out of said plane.

4. An Axminster gripper loom comprising:

a. yarn carriers and grippers, b. means for moving said yarn carriers and grippers relative to each other to draw lengths of yarn from the yarn carriers, all the drawn yarns being in substantially a single plane in the region between the yarn carriers and the grippers, c. means for conditioning only selected ones of said yarn carriers for additional movement, d. means for moving only said selected yarn carriers to shift their respective yarns out of the plane occupied by the unselected yarns in the region between the yarn carriers and grippers, e. means for engaging only said selected yarns to lengthen them by drawing additional yarn off the selected yarn carriers, and f. means for cutting all the yarns.

5. An Axminster gripper loom as defined in claim 4 wherein said means for moving selected yarn carriers includes a series of spaced apart pins carried by each of said yarn carriers, and a lifting means engagable with any selected one of said pins on each yarn carrier for moving said yarn carriers.

6. An Axminster gripper loom as defined in claim 5 wherein said conditioning means includes a jacquard card having a predetermined pattern of holes, and means responsive to the hole pattern for moving selected pins of selected yarn carriers into the path of movement said lifting means.

7. An Axminster gripper loom as defined in claim 5 including a pair of cams for controlling the movement of said lifting means, means for rotating said cams in unison, and follower means cooperating with one of said cams for moving said lifting means towards and away from said yarn carriers, and follower means cooperating with the other of said cams for moving said lifting means in a direction which moves said selected yarn carriers to move their respective yarns out of the plane of the unselected yarns.

8. An Axminster gripper loom as defined in claim 4 wherein said means for lengthening the selected yarns and for cutting all the yarns comprises a cutting knife movable across all the yarns to cut them, and a finger spaced forwardly of said cutting knife with respect to the direction of movement of the knife during cutting, said finger being movable with said cutting knife and arranged to engage only said selected yarns.

* * * * *